United States Patent [19]

Birkle et al.

[11] 4,415,422

[45] Nov. 15, 1983

[54] APPARATUS FOR ELECTRO-DEPOSITING ALUMINUM

[75] Inventors: Siegried Birkle, Aisch; Johann Gehring, Spardorf; Klaus Stöger, Nuremberg, all of Fed. Rep. of Germany

[73] Assignee: Siemens Aktiengesellschaft, Berlin & Munich, Fed. Rep. of Germany

[21] Appl. No.: 330,942

[22] Filed: Dec. 15, 1981

[30] Foreign Application Priority Data

Jan. 22, 1981 [DE] Fed. Rep. of Germany ..... 3102021

[51] Int. Cl.[3] ..... C25D 17/02; C25D 17/06; C25D 17/28; C25C 3/00

[52] U.S. Cl. ..... 204/199; 204/202; 204/225; 204/246; 204/297 R

[58] Field of Search ..... 204/199, 202, 225, 243–247, 204/14 N, 39, 297 R

[56] References Cited

U.S. PATENT DOCUMENTS 4,053,383 10/1977 Dötzer et al. ..... 204/225
4,176,034 11/1979 Stoger et al. ..... 204/200
4,265,726 5/1981 Herrnring et al. ..... 204/245 X
4,363,712 12/1982 Birkle et al. ..... 204/199

*Primary Examiner*—Donald R. Valentine
*Attorney, Agent, or Firm*—Hill, Van Santen, Steadman & Simpson

[57] ABSTRACT

An improved galvanizing device for the galvanic precipitation of aluminum from an anhydrous, aprotic, and oxygen-free aluminum-organic electrolyte is provided. The known device having an annularly shaped galvanizing trough, which is sealed from the atmosphere and which utilizes a centrally located, rotatable support mechanism which guides the goods carriers through the electrolyte in a circular, rotating manner, and also furnishes the goods carriers with an electrical contact, is herein provided with separate charging and discharging locks attached to the galvanizing trough. Each of the locks is provided with a U-shaped fluid lock to maintain the gaseous seal and an endless chain conveyor to transport the goods carriers to and from the galvanizing trough. Additionally, the anode plates which are located in the electrolyte trough are provided with a transport rod to permit their removal and replacement in a manner similar to that utilized with the goods carriers.

8 Claims, 6 Drawing Figures

APPARATUS FOR ELECTRO-DEPOSITING ALUMINUM

BACKGROUND OF THE INVENTION

1. Field of the Invention

The present invention relates to a device for the galvanic precipitation of aluminum from aprotic, oxygen- and water-free, aluminum organic electrolytes. More particularly, the invention relates to such a device having an electroplating vat which is sealed from the outside and can be charged with a protective atmosphere. The vat has an annularly shaped, closed electrolyte trough and an electrical contacting and support device which can be rotated around a vertical axis within the vat. The support device has support arms radiating outwardly from the vertical axis which support the goods holders and, when the entire device is rotated, guide the holders through the trough. The electrolyte vat further contains a plurality of anode plates which are interchangeably disposed within the electrolyte trough and a charging and discharging fluid lock for the passage of goods holders to and from the electroplating trough. By providing the goods holders with a horizontal transport bar, the goods holders are transported, by an endless chain conveyor which engages with the transport bar, through the charging lock and into the electroplating trough, where it is held by the support arms of the support and contacting device. After treatment, the goods holders may also be automatically removed from the support arms and transported out through the discharging lock on a second endless chain conveyor.

2. Description of the Prior Art

A galvanic precipitation apparatus of this type is described in our earlier German application No. P 30 44 975.3, filed Nov. 28, 1980 which was the basis of a copending U.S. patent application Ser. No. 318,812, filed Nov. 6, 1981 that issued as U.S. Pat. No. 4,363,712 on Dec. 14, 1982. As disclosed therein, in order to prevent the inward diffusion of oxygen and water vapor into the electrolyte when the goods holders are introduced, and to prevent the outward transfer of the electrolyte when the goods holders are removed, the preliminary and main chambers of the charging and discharging lock are connected to one another by a fluid lock filled with an aprotic solvent. The outward transfer of the electrolyte from the electroplating trough upon the removal of the goods carriers is prevented by providing a rinsing zone between the electroplating vat and the fluid lock of the discharging passageway. In this zone, the electroplated goods and the goods holders are cleansed of the electrolyte. The provision of an endless chain conveyor in both of the charging and discharging passageways completes the mechanism and provides a simple and economical loading and unloading of the electroplating vat.

In the earlier application, the goods holders consist of a frame to which the work pieces to be aluminized are secured by electrically conductive support wires. The frame itself is also electrically conductive and is connected to the negative pole of a current source by the support arms of the contacting and supporting device. The various support arms may be separately supplied with an electrical current so that various selected depositing conditions can be set for different work pieces. In addition, the individual support arms can be selectively loaded or unloaded simultaneously or in a specified mechanical manner without interruptions.

The automatic transfer to and from the support arms of the contacting and supporting arms is achieved by providing the goods holders with a transport rod with which hook-shaped dogs of the endless chain conveyors may engage. The ends of the transport rods are designed to serve as support and electrically contacting pegs and are received by the shaped ends located on the forked support arms of the contacting and supporting device.

With commercial electroplating systems, it is necessary that the plate-shaped anodes be replaced from time to time, as they can only be used while they are of a certain thickness. Generally, the replacement of these used anodes does not present a particular problem, as the open shape of the electroplating vats makes them easily accessible. This however is not the case with the electroplating system described in our earlier application, or the ones described in German Letters Patents Nos. 2,537,256 and 2,716,805. With these electroplating systems, an aprotic electrolyte system which has a sensitivity to both moisture and air, is utilized. This sensitivity requires these systems to be closed to air. Thus, the anodes are secured in the electroplating vat prior to the introduction of the electrolyte, and the anodes cannot be replaced so long as the system is in operation.

When such closed, annular electroplating systems were utilized, particularly those using organo-aluminum complex salt electrolytes the replacement of the anode plates was accomplished by removing the electrolyte from the vat and then interchanging the anode plates either after removal of the entire cover system or by using selected openings in the upper cover. This method, particularly in larger systems, was involved and time consuming. Additionally, electrically disruptive coatings were formed on the inside walls of the system due to the unavoidable incursion of air, and these coatings proved difficult to remove.

SUMMARY OF THE INVENTION

The present invention has as an underlying objective to improve a device of the type which has been above-described, in such a manner that it is possible to interchange anode plates even during operation. The resolution of this object is inventively achieved by providing the anode plates, like the goods holders, with transport rods. Thus, like the goods holders, by using the transport rods, the anode plates can be introduced or removed from the electroplating vat through the charging and discharging passageways using the chain conveyors. Additionally, they can be positioned in the electroplating vat utilizing the contacting and supporting device.

After having been conveyed to the support arms the anode plates may be removed from their mounts utilizing a lifting and displacement device. They may then be set in their proper radial position. Similarly, with the assistance of the lifting and displacement device, the used anode plates may be removed from their mount and transferred to the support arms of the contacting and supporting device. From there, they are conveyed into the discharging passageway and conducted to the outside using the second chain conveyor. The anode plates, like the goods holders, may be rinsed upon removal from the electrolyte with an inert fluid, and thus remove any still-adhering electrolyte.

The cover plate of the electroplating device is preferably provided with a plurality of radially-elongated, slot-shaped openings which are located at a certain radius about the cover plate. Their plurality corresponds to the plurality of interchangeable anode plates, and the slot-shaped openings may be closed with covers during the electroplating operation. Corresponding to these covers is a base plate on the lifting and displacement device. The base plate and covers are so designed such that when the base plate of the lifting and displacement device is placed adjacent to the cover plate, the base plate may be used to laterally push aside the cover plate replacing the cover plate and maintaining the opening in a closed position at all times with respect to the outside air. The base plate thus serves as a temporary cover for the opening during the displacement operation for the anodes.

Various other objects, advantages, and features of the present invention will become readily apparent from the ensuing detailed description and the novel features will be particularly pointed out in the appended claims.

DESCRIPTION OF THE PREFERRED EMBODIMENTS

Figure 1:
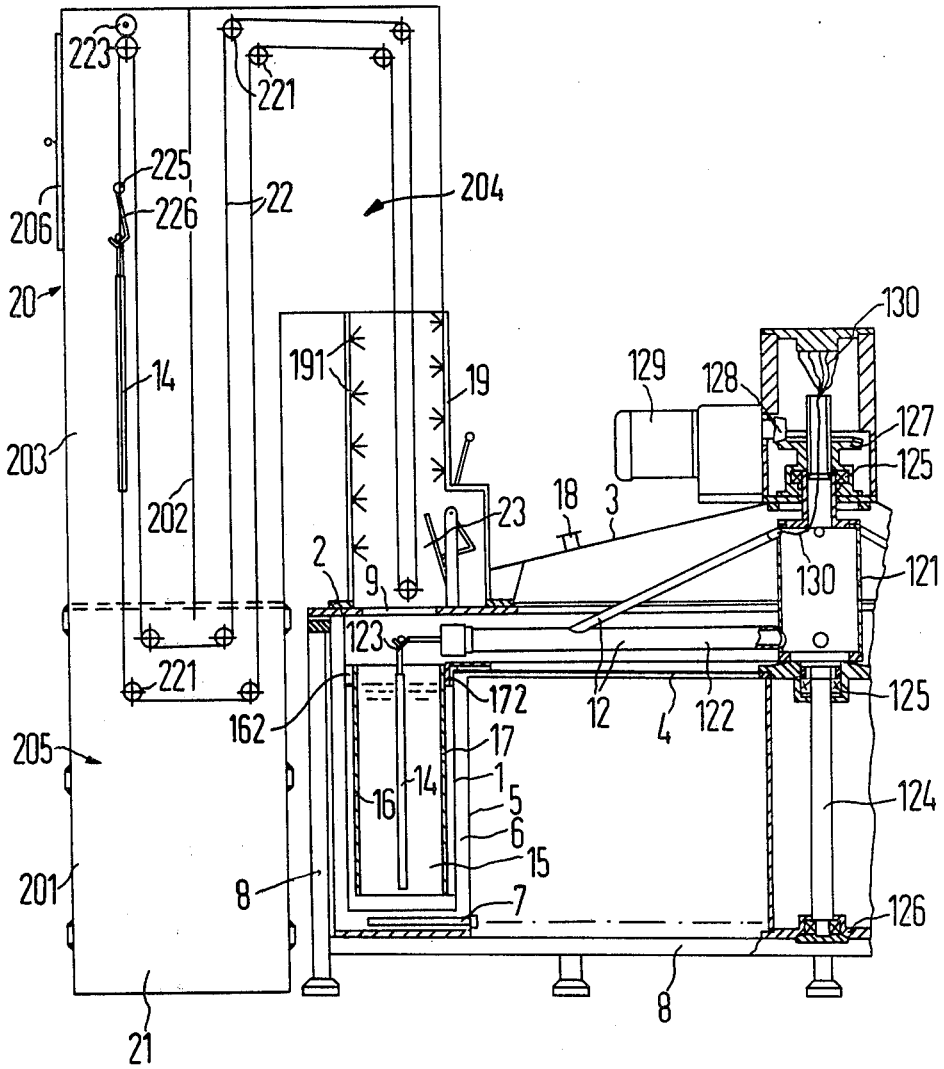
FIG. 1 is a side elevational view, partially in section, showing a portion of a galvanizing device according to the present invention.
Figure 2:
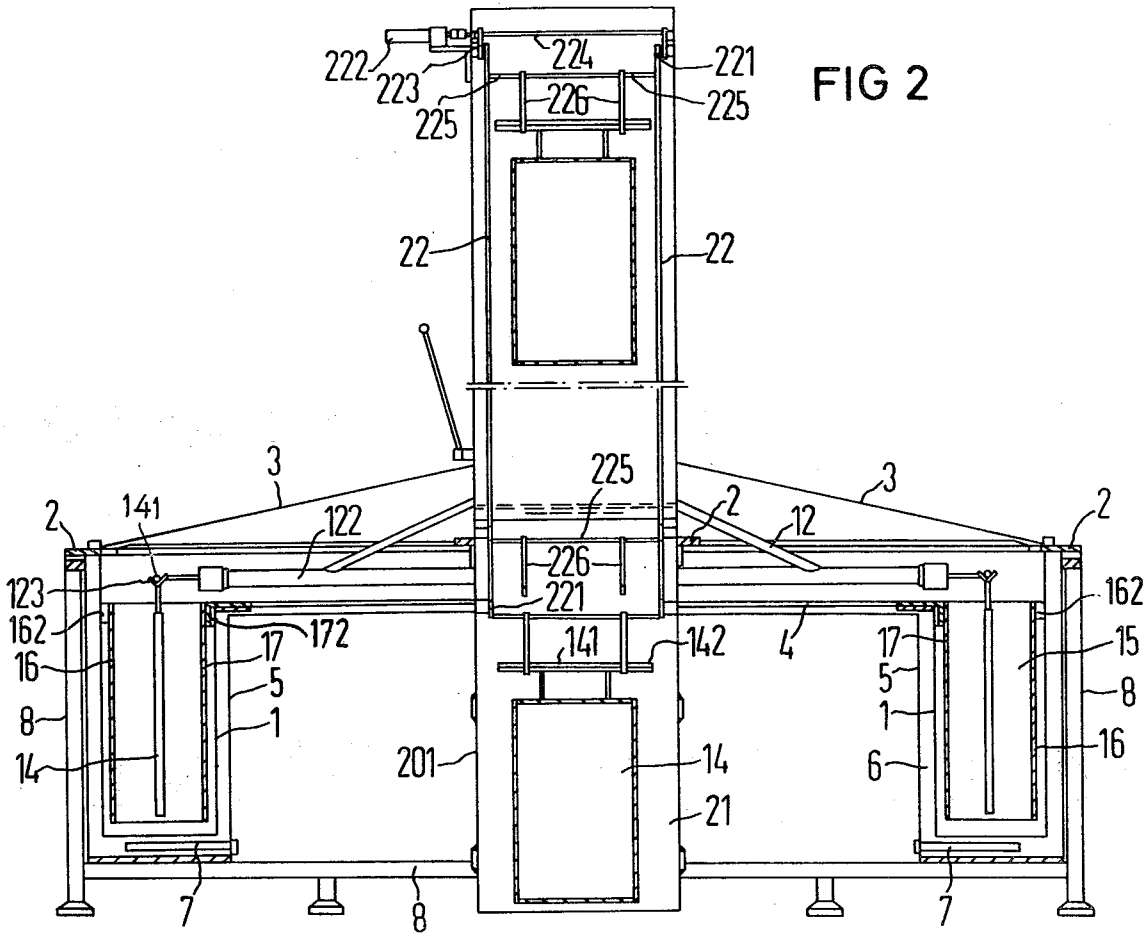
FIG. 2 is a side elevational view, partially in section, showing in full a galvanizing device according to FIG. 1.
Figure 3:
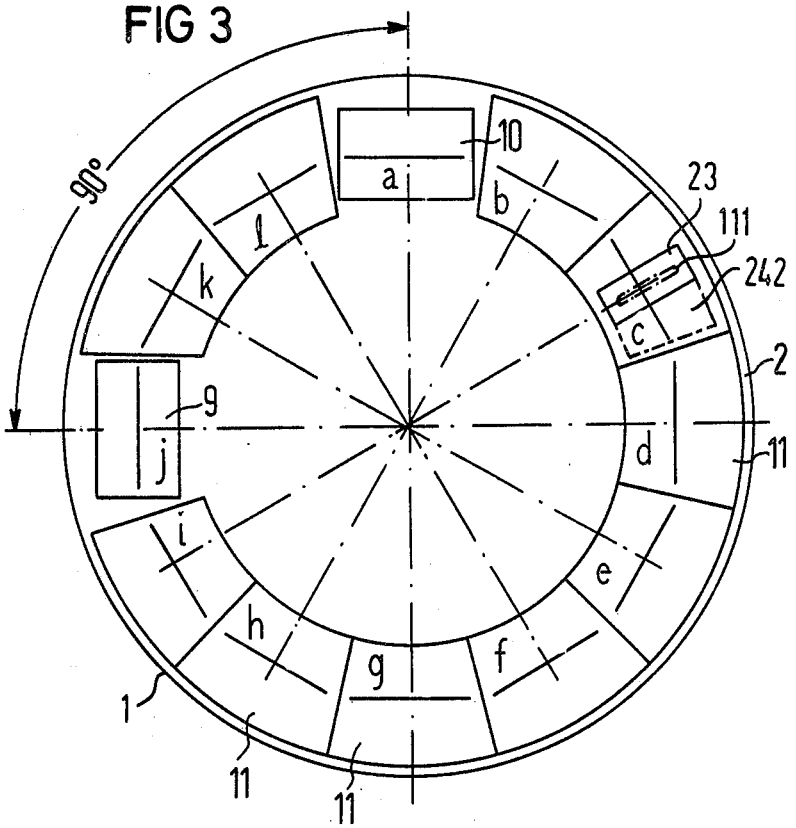
FIG. 3 is a top plan view showing schematically a galvanization tank according to the present invention.

The galvanization apparatus as illustrated in FIGS. 1–3 essentially corresponds to the electroplating apparatus disclosed in our earlier German application No. P 30 44 975.3, which was the basis of the above mentioned U.S. patent application Ser. No. 318,812, now U.S. Pat. No. 4,363,712. The electroplating vat consists of a circular, rotationally symmetric electrolyte trough 1, having an upper closing cover 2, an upper closing cap 3, and a lower closing cap 4. The electrolyte trough 1 is suspended in a heating vat 5, which is likewise circular and rotationally symmetric, and serves as the receptacle of a heating bath 6, for example an oil bath. The heating of the heating bath 6 can be accomplished by heating cartridges 7, as illustrated by FIGS. 1 and 2, or by other means such as a separate heating circuit through which a heated fluid circulates. The electrolyte trough 1 and the heating vat 5 are suspended together in a frame 8, which supplies the needed, over-all static stability. The upper closing cover 2, which is also essentially annularly designed, is attached to the cylindrical outside wall of the electrolyte trough 1, said upper closing cover 2, being in turn connected to the upper closing cap 3. The upper closing cover 2 exhibits two inside lock openings 9 and 10, angularly displaced by 90° as is shown in FIG. 3. Only lock opening 9 in the closing cover 2 is shown in FIG. 1.

As is shown in FIG. 3, openings a–l are distributed around the circumference of the upper closing cover 2 and are closed by means of removable cover segments 11. Due to the different heights of the outer wall and inner wall of the electrolyte trough 1, a space is created in the galvanizing vat between the upper closing cover 2 and the upper closing cap 3 on the one hand, and the lower closing cap 4 on the other. This free space provides room to accommodate a contacting and supporting device, which has been assigned on over-all reference numeral 12. The contacting and support device 12 consists of a rotor 121 to which a plurality, here twelve, support arms 122 having receptacles 123 at their outer, fork-shaped ends, are attached in uniform distribution. The shaft 124 of the rotor 121 is centrally located with respect to the electrolyte trough 1, and is rotatably seated using two gas-tight, face-type end shields 125, and is supported toward the bottom by an axial thrust bearing 126 connected to the frame 8.

The rotational power is supplied to the rotor 121 from above the upper closing cap 3 by a gear motor 129, with bevel wheels 127 and 128. The drive motor 129 is selected to have an explosion-proof design. Each of the support arms 122 exhibits a separate cathode terminal 130. In FIG. 1, only the cathode terminal for the support arm 122 lying in the cutting plane of FIG. 1 is illustrated in the drawing. The connection of the cathode terminals 130 to their specific receptacles 123 can be, for example, by carbon brushes and slip rings. This possibility, and other known methods, are not illustrated in greter detail in the drawings.

Figure 6:
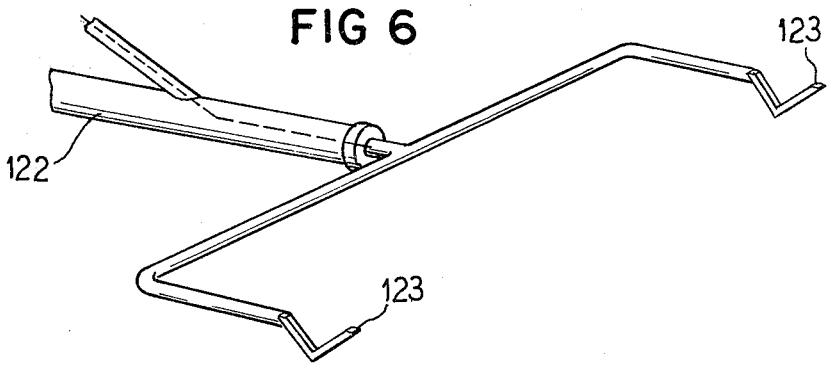
FIG. 6 is a fragmentary perspective view showing the outer portion of a support arm according to FIGS. 4 and 5.
Figure 4:
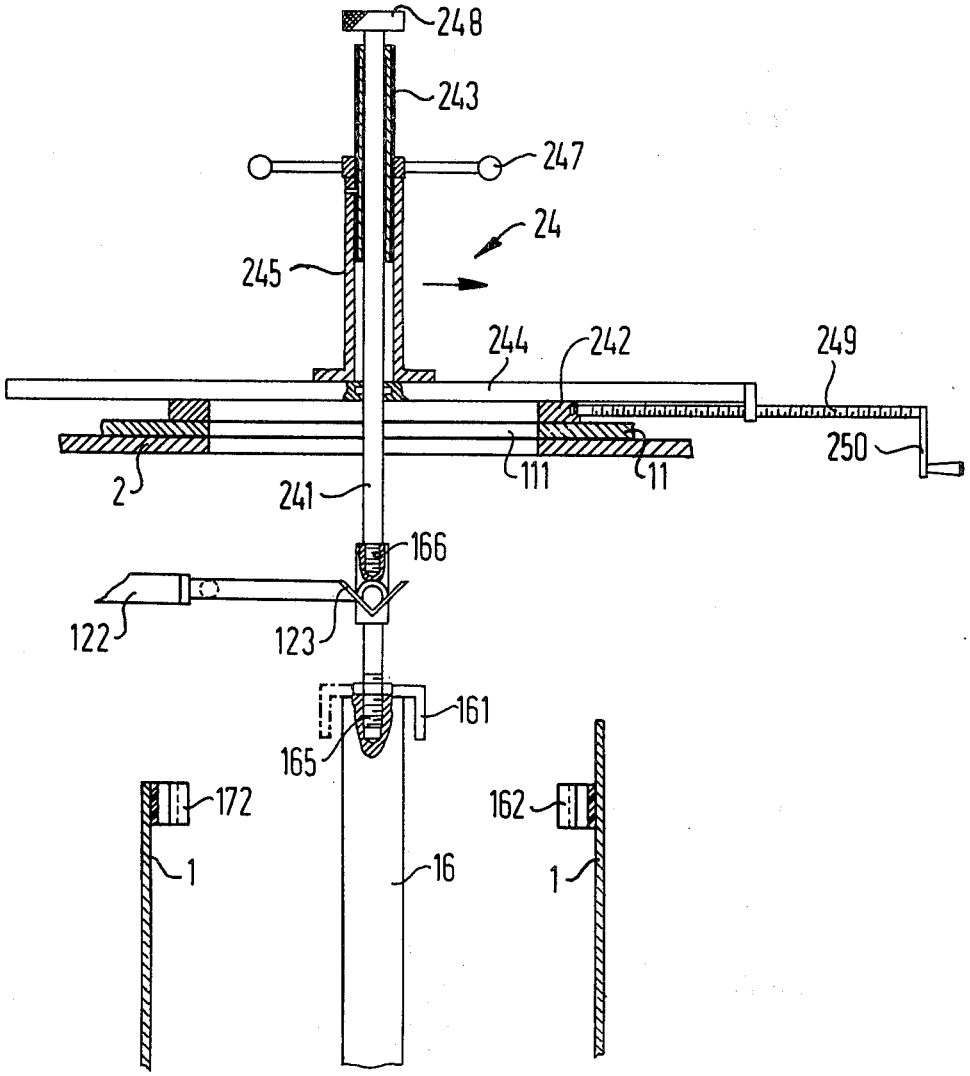
FIG. 4 is a side elevational view, in section, showing a lifting and displacement device and its operational relationship with a support arm and an anode plate.
Figure 5:
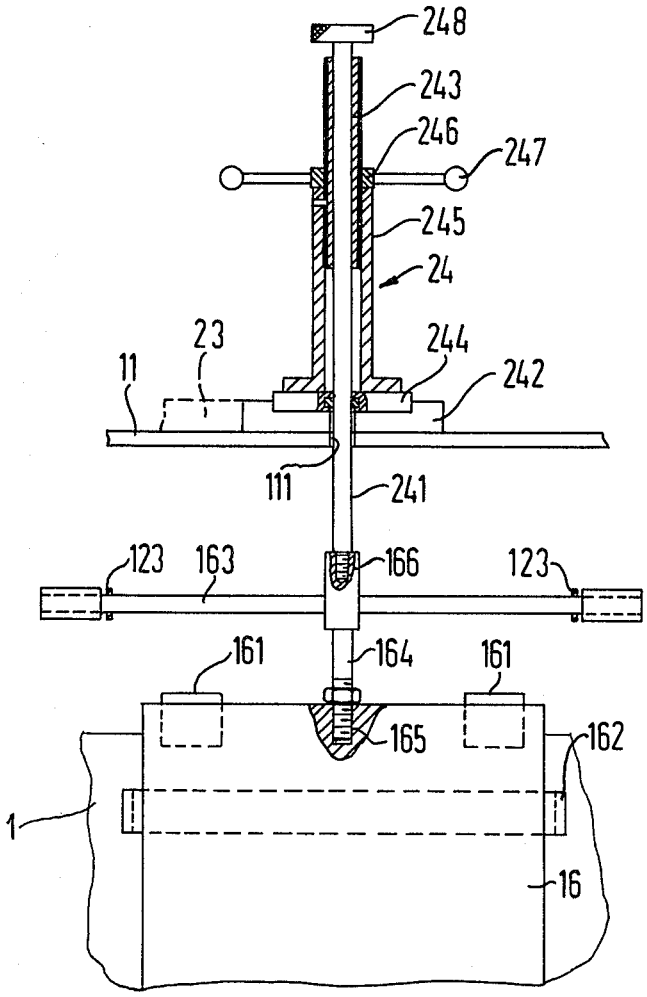
FIG. 5 is a side elevational view, in section, of the lifting and displacement device according to FIG. 4.

As can be seen in greater detail on the basis of FIGS. 4, 5, and 6, the free ends of the support arms 122 are designed as branched or fork-shaped, and have receptacles 123 at each of their branched ends. The correspondingly designed ends of a transport rod 141, which are connected to a goods holders or carrier 14, can be hooked or attached to said receptacles 123 (see FIG. 2). The electrical current transfer is promoted due to the angular profile of the contacting pegs 142 and the correspondingly angularly designed pick-ups 123. The goods holders 14 consist of a type of frame in which the work pieces to be aluminized are secured. The goods holders 14 can, for example, consist of a type of frame wherein the work pieces are secured by electrically conductive support wires.

With the rotary motion of the contacting and support device 12, the work pieces can be conducted on a circular path through an electrolyte 15 which has been introduced into the electrolyte trough 1. Outer anode plate 16 and inner anode plate 17 are arranged to form inner and outer rings, these rings are at equal distances from the circulatory path of the goods holders 14. As can be seen in greater detail from FIGS. 4 and 5, the anode plates 16 and 17 are provided with two shackles 161 at their upper end so that they may be suspended in corresponding anode suspensions 162 and 172. The anode suspensions 162 and 172 are secured with appropriate insulation to the inside or to the outside wall of the electrolyte trough 1. The current is supplied to the inner and outer anode suspensions 162 and 172 in a manner which is standard in electroplating technology, (for example by cables which are passed through the walls of the electrolyte trough 1 and the heating vat 5 using electrically insulating seals), and is not illustrated in greater detail.

In order to protect the anhydrous, oxygen-free aluminum organic electroplyte 15, the galvanization vat is charged with a dry, protective gas which may be supplied through a nozzle 18 in the upper cover cap 3. The gas flowage is metered in such a manner that it is always under a slight overpressure. In this manner, the air space formed in the galvanization vat is charged with the protective gas, forming an atmosphere which is closed toward the outside. To preserve this atmosphere necessitates that the introduction and/or removal of goods holders 14 be made only through the aforementioned inner lock openings 9 and 10. So that no ambient air can penetrate into the galvanizing vat at these locations either, a shaft-shaped condensation space 19 is provided above the inner lock opening 9, with a charging lock 20 (shown in FIG. 1) being connected to said condensation space 19. In an analogous manner, (though not shown in the illustrations) the inner lock opening 10 is also provided with a condensation space and a discharging lock, corresponding to the condensation space 19 and the charging lock 20.

The charging lock 20 consists of a container 201 having a rectangular base in which an aprotic solvent 21 is situated. The container 201 is sub-divided into a preliminary chamber 203 and a main chamber 204 by a partition 202 which extends downwardly into the solvent 21. The main chamber 204 forms a continuous, sealed attachment with the condensation space 19. Thus, the solvent 21 and the partition 202, partially extending into said solvent 21, form a fluid lock 205 which prevents the infiltration of air and humidity into the main chamber 204, and thus into the electrolyte 15.

The preliminary chamber 203 is provided with an input opening 206 (which can closed vacuum-tight) for the goods holders 14. The goods holders 14 can then be transferred with the assistance of an endless conveyor chain 22, from the preliminary chamber 203, through the fluid lock 205, and into the main chamber 204. From there, the goods holders 14 may be lowered into the galvanizing vat via the condensation space 19. As can particularly be seen in FIG. 2, two conveyor chains 22 are provided, parallel to one another, and attached to rollers 221 located in opposite side walls of the container 201. The conveyor chains 22 are capable of being driven in common, a gear motor 222 driving a shaft 224 using a transmission 223. Cross arms 225 are disposed between and attached to the conveyor chains 22, said cross arms 225 automatically seizing thetransport rods 141 of the goods holders 14 using carrier hooks or engaging dogs 226, and then depositing them in the receptacles 123 of the support arms 122.

In order to load the electroplating vat with the goods holders 14, the input opening 206 of the preliminary chamber 203, which has been preferaably previously flooded with an inert gas, is opened. A goods holder 14, holding the goods to be galvanized is suspended on the conveyor chains 22 by the engaging dogs 226, and the input opening 206 is again closed. Subsequently, the conveyor chains 22 are placed in motion, whereby the goods holder 14 is conveyed through the fluid lock 205 and into the main chamber 204. Conveyance continues, and the goods holder 14 is delivered to the receptacles 123 of the pick-up arms 122, where the engaging dogs 226 automatically disengage from the transport rod 141.

The removal of the goods holders 14 from the electrolyte trough 1 ensues in a similar manner, one difference being that the conveyor chains 22 move in the opposite direction. The engaging dogs 226 automatically grasp the transport rods 141 of the goods carriers 14 and convey them to a discharge opening (not shown), which is located analagously to the input opening, but in the discharging lock. As needed, the inner lock openings 9 and 10 can each also be closed to the outside with the assistance of covers 23, which can be operated from the outside. This can be necessary, for example, when the main chamber 204 must be aired out for any of various reasons.

At the discharging lock, the condensation space 19 may be equipped with spray nozzles 191 for the purpose of spraying or rinsing the galvanized goods and the goods holders 14 with a solvent which is compatible with the electrolyte 15. As required, the cover 23 can also be closed for rinsing the goods, and the solvent employed for the spraying can be provided with its own circulation system.

According to the present invention, the anode plates 16 and 17, like the goods holders 14, are provided with corresponding transport rods 163. As shown in FIGS. 4 and 5, a double transport junction 164 is utilized to connect the transport rod 163 to the anode plate 16 by a screw-type connection 165. The double transport junction 164 is provided at its upper end with a threaded bore 166 which receives a coupling rod 241 of a lifting and displacement device 24. When such a device is put in place above a cover segment 11, the coupling rod 241 may be selectively engaged with the transport junction 164 through a radial slot 111 in the cover segment 11. The coupling rod 241 is of such a length that the anode plate 16 may be positioned for suspension by the shackles 161 in either the outer or inner anode suspension 162 or 172. In an alternate embodiment, two coupling rodes 241 (not shown) may be provided, being located at both sides of the conveyor chain 22.

Like the goods holders 14, the anode plates 16 and 17 may be suspended by their transport rod 163 from the engaging dogs 226 of the conveyor chain 22 after loading them through the input opening 206. Subsequently, the input opening 206 is again closed and the conveyor chain 22 is placed in motion. The anode plate 16 is then conducted through the fluid lock 205, and into the main chamber 204 and condensation space 19. Conveyance continues into the electrolyte trough 1 where the anode plate 16 is transferred from the engaging dogs of the conveyor chain 22 to the receptacles 123 of the contacting and support device 12. Of course prior to this time, the goods holder 14 must have been previously removed from this support arm 122 and the anode plate which is being replaced must also have been previously removed. As soon as the anode plate 16 has been delivered to the receptacle 123, the rotor 121 and the contacting and support device is placed in motion with the support arm 122 transporting the anode plate 16 to its appropriate, replacement position.

Normally, the radial slot 111 and the cover segment 11 is closed by cover 23, (see FIG. 3). The base plate 242 of the lifting and displacement device 24 is put in place next to cover 23. The base plate 242 is then laterally moved in such a manner as to push the cover 23 from its covering position, with the base plate 242 finally being brought into the position illustrated in FIGS. 4 and 5, in which the coupling rod 241 is situated above the slot 111. The coupling rod 241 is disposed in a threaded sleeve 243 so as to be axially displaceable. The threaded sleeve 243 is located in a pipe socket 245 which is secured to a slide 244 of the base plate 242. The coupling rod 241 being axially movable with the assistance of a threaded nut 246 which is supported at its end face by the outward end of the pipe socket 245. The threaded nut 246 is provided with a purchase 247. A knurled head 248 is provided at the end of the coupling rod 241, and with which the coupling rod 241 may be screwed into the threaded bore 166 of the double transport junction 164. When the threaded nut 246 is moved by means of turning the purchase 247, the threaded sleeve 243 and thus the attached coupling rod 241 with the anode plate 16 suspended therefrom, begin riding up. When the upper end of the threaded sleeve 243 strikes the knurled head 248, the lifting of the anode plate 16 has occurred to such a degree that the transport rod 163 of the anode plate 16 has been lifted out of the receptacles 123. By turning a spindal 249 with crank 250, the slide 244 of the base plate 242 may be moved a selected distance inward or, for example, outward as in the direction of the arrow in FIG. 4. Subsequent turning of the purchase 247 permits the coupling rod 241 and anode plate 16 to lower, and with further outside movement, the shackle 161 of the anode plate 16 can be received by the anode suspension 162. The lifting and displacement device 24 can then be returned to its initial position, whereupon the coupling rod 241 is withdrawn from the longitudinal slot 111, and the lifting and displacement device removed after displacing the base plate 242 with the cover plate 23.

The now vacant support arm 122 can subsequently be brought into the next position in order to be used to lift a further anode plate 16 or 17 for replacement. Replacement may ensue in an analagous fashion to what has been above-described simply by reversing the steps. The anode plate 16 or 17 is removed from an anode suspension and deposited into the receptacles 123, whereupon the support arm 122 is rotated to a position under the inner lock opening 10 of the discharging lock. The respective support arm 122 may be automatically unloaded by starting the conveyor chain 22 of the discharging lock. The anode plate is then discharged to the outside in an analagous manner to that described for its loading.

When the anode plates 16 and 17 are located below the inner lock openings 9 and 10, a slight modification in the lifting and displacement device is required. Instead of being covered by cover segment 11, the inner lock openings 9 and 10 are connected to the main chamber 204 of the charging or discharging lock. In this instance, the lifting and displacement device 24 is placed at the upper side of the housing of the main chamber 204, in such a manner that the appropriately lengthened coupling rod 241 extends through the condensation shaft 19 to the anode plates 16 and 17. Thus, the coupling rod 241 must be lengthened by the height of the main chamber 204.

While we have disclosed an exemplary structure to illustrate the principles of the invention, it should be understood that we wish to embody within the scope of the patent warranted herein all such modifications as reasonably and properly come within the scope of our contribution to the art.

We claim as our invention:

1. In a galvanizing apparatus for the galvanic precipitation of aluminum from an anhydrous, aprotic, and oxygen-free aluminum-organic electrolyte, said apparatus having an annularly shaped electrolyte trough for receiving an electrolyte, said trough having a plurality of anode plates arranged around a vertical axis of the trough and having cover means including cover segments for sealing the electrolyte in the trough from the atmosphere and for enabling charging of the trough with a protective gas to form a protective atmosphere, a rotatable contacting and holding device having a vertical rotational axis, said device being mounted for rotation in said trough with the rotational axis being on the vertical axis of the trough, the device having a plurality of support arms radiating outwardly from the rotational axis with goods carriers being able to be selectively attached to the support arms for passage around and through the electrolyte trough, a charging lock and a discharging lock, both of said locks being attached to the electrolyte trough and each including a preliminary chamber, a main chamber, a U-shaped fluid lock connecting said preliminary chamber to the main chamber and forming a gaseous seal, and an endless chain conveyor attached to and running continuously through the preliminary chamber, the main chamber and the fluid lock the improvement comprising a transport rod being attached to each anode plate and receivable by said support arms, and a lifting and displacement device being selectively attachable to one of the cover segments of the electrolyte trough and having a portion which is selectively engageable with an anode plate, so that while maintaining the protective atmosphere, an anode plate may be changed and replaced by being lifted by the lifting and displacement device from a place of suspension in the trough and placed on the support arm to be carried to the discharging lock for removal from the trough and a different plate is conveyed through the chambers of the charging lock placed in the support arm for movement in the trough to the lifting and displacement device for insertion in the place of suspension.

2. In a galvanizing apparatus according to claim 1, wherein each cover segment is provided with a closable opening and a portion of the lifting and displacement device being able to extend through said opening to engage the anode plate.

3. In a galvanizing apparatus according to claim 2, wherein the closable opening is in the form of a radial slot.

4. In a galvanizing apparatus according to claim 2, wherein the lifting and displacement device further includes a base plate slidably mounted to a bottom portion of the lifting and displacement device, said base plate being of a sufficient size to cover said closable opening, so that when a cover for the closable openings is pushed away by the base plate, the opening remains closed to the atmosphere.

5. In a galvanizing apparatus according to claim 4, wherein the lifting and displacement device further includes a pipe socket secured to a slide of the base plate, and a coupling rod slidably received by said pipe socket and able to be adjustably extended downwardly through an opening in said base plate and into the trough when the lifting and displacement device is attached to the galvanizing apparatus.

6. In a galvanizing apparatus according to claim 5, wherein the lifting and displacement device further includes a threaded nut attached to an open end of the pipe socket, and a threaded sleeve surrounding the coupling rod and engageable with the threaded nut, whereby the coupling rod may be axially moved by turning the threaded sleeve in the nut.

7. In a galvanizing apparatus according to claim 5, wherein the lifting and displacement device includes means having a threaded spindle attached both to the base plate and the slide of the base plate for creating adjustable, relative movement between the base plate and the coupling rod attached to the slide of the base plate.

8. In a galvanizing apparatus for galvanic precipitation of aluminum from an anhydrous, aprotic and oxygen-free aluminum-organic electrolyte, said apparatus having an annular-shaped electrolyte trough for receiving an electrolyte, said trough having a plurality of anode plates arranged around a vertical axis of the trough and having a cover means including cover segments for sealing the electrolyte in the trough from the atmosphere and to enable charging of the trough with a protective gas to form a protective atmosphere, a rotatable contacting and holding device having a vertical rotational axis, said device being mounted for rotation in said trough with the rotating axis being on the vertical axis of the trough, the device having a plurality of support arms radiating outwardly from the rotational axis for receiving goods carriers from a charging lock to transport the goods carriers through the electrolyte trough to a discharging lock, said charging and discharging locks being attached to the electrolyte trough and each including a preliminary chamber, a main chamber, a fluid lock connecting the preliminary chamber to the main chamber and forming a gaseous seal therebetween and an endless chain conveyor attached to and running continuously through the preliminary chamber, the main chamber and fluid lock, the improvements comprising means for enabling changing and replacing of anode plates without destroying the protective atmosphere in the trough, said means including each of the anode plates being provided with a transport rod, said transport rod being receivable in said support arms and a lifting and displacement device being selectively attachable to one of the cover segments of the electrolyte trough and having a portion which is selectively engageable with an anode plate so that an anode plate can be inserted and removed from the trough through one of the locks and an anode plate can be removed from its place of suspension and inserted in place of the suspension by the lifting and displacement device.

* * * * *